US005341667A

United States Patent [19]

Lee, Jr.

[11] Patent Number: 5,341,667

[45] Date of Patent: Aug. 30, 1994

[54] CONTAINER BOTTOM WALL REFORMING APPARATUS AND METHOD

[75] Inventor: Harry W. Lee, Jr., Chesterfield County, Va.

[73] Assignee: Reynolds Metals Company, Richmond, Va.

[21] Appl. No.: 877,559

[22] Filed: May 1, 1992

[51] Int. Cl.[5] ..... B21D 51/26

[52] U.S. Cl. ..... 72/379.4; 72/94; 72/402; 413/69

[58] Field of Search ..... 72/94, 110, 111, 353.4, 72/354.2, 379.4, 401, 402; 413/69

[56] References Cited

U.S. PATENT DOCUMENTS

| | | | |
|---|---|---|---|
| 1,695,232 | 12/1928 | Fink | 72/354.2 |
| 2,158,312 | 5/1939 | Terrell | 72/353.4 |
| 2,211,622 | 8/1940 | Hunziker | 72/402 |
| 2,658,549 | 11/1953 | Pechy | 72/401 |
| 3,406,554 | 10/1968 | Frankenberg . | |
| 3,983,729 | 10/1976 | Traczyk et al. | 413/69 |
| 4,289,014 | 9/1981 | Maeder et al. . | |
| 4,571,978 | 2/1986 | Taube et al. . | |
| 4,885,924 | 12/1989 | Claydon et al. | 72/111 |
| 4,903,521 | 2/1990 | Bulso, Jr. et al. . | |
| 5,014,536 | 5/1991 | Saunders . | |
| 5,069,052 | 12/1991 | Porucznik et al. | 72/110 |
| 5,222,385 | 6/1993 | Halasz et al. | 72/117 |

FOREIGN PATENT DOCUMENTS

| | | | |
|---|---|---|---|
| 0482581 | 4/1992 | European Pat. Off. | 72/379.4 |
| 91/11275 | 8/1991 | World Int. Prop. O. | 72/94 |

*Primary Examiner*—Lowell A. Larson
*Attorney, Agent, or Firm*—Robert C. Lyne, Jr.

[57] ABSTRACT

A container is formed with a bottom wall comprising a central panel and a resting radius formed from an annular wall depending downwardly from the central panel periphery and then outwardly and upwardly to join the container side wall. A method is disclosed which reduces the resting radius by tightening the curvature thereof through deformation of the outer annular wall so that the resting radius is better able to resist eversion under the influence of pressure within the container. The outer wall is deformed by radially inward flexing of plural fingers which are cammed radially inwardly into contact with it through a cam follower arrangement which also controls a can support member to (1) locate the bottom wall in a first position between the reforming fingers and supporting anvil, and (2) in a second, elevated stripping position where the container is removed from the apparatus. The container bottom wall is preferably reformed during necking-in of the container open end.

27 Claims, 6 Drawing Sheets

CONTAINER BOTTOM WALL REFORMING APPARATUS AND METHOD

TECHNICAL FIELD

The present invention relates to method and apparatus of forming containers and, more particularly, to a method and apparatus for reforming a container bottom wall.

BACKGROUND ART

Metal containers used for distribution of consumable beverages must withstand an internal pressure of at least 90 psi to ensure integrity of the can when it reaches the consumer. Such cans are therefore formed from aluminum alloy or steel and are wall ironed to create a relatively thin metal side wall and a thick metal bottom wall having a hollow central portion. The interior of the can is coated with a protective lacquer coating and the bottom end wall is pressed into a final shape between a punch engaging the external surface of the hollow portion of the bottom end and a hollow die entering the can to support an annulus of bottom end material around the hollow portion. Cooperation of the punch and die pulls the end material to conform to the punch and die profiles to create a bottom having an inward countersink zone and an outward conical or radial surface which are connected by a resting radius.

The resistance of the inwardly domed portion to outward bulging is greatly influenced by the size of the resting radius. The smaller the resting radius, generally the higher the possible internal pressure resistance of the can. However, the aforementioned forming process works most advantageously if the resting radius is large. This is to ensure that the metal does not fracture or reduce in thickness when it is pulled around the radius on the forming tools. Unfortunately, however, the larger forming radius reduces the internal pressure characteristics of the can.

It is accordingly one object of the present invention to reduce the resting radius of a beverage metal can bottom to increase the internal bulge strength of the bottom.

Another object of the invention is to reduce the base thickness of metal in the bottom while still maintaining sufficient strength to withstand the product's internal pressure.

Another object is to reform the resting radius of the bottom after cleaning, printing and coating of the can as aforesaid.

A method of reforming the resting radius of a can bottom wall is disclosed in U.S. Pat. No. 4,885,924 which is assigned to Metal Box p.l.c., Reading, England. Therein, a container is rotated by support means while a roll is applied thereto and moved radially inwardly towards the container axis to contact the resting radius. This patented process has at least two disadvantages. First, it requires a separate machine requiring extra controls and conveying which adds complexity and lengthens the can line process. A second disadvantage is that the separate machine is expensive, not to mention the cost of installation and extra conveying equipment.

Another object of the present invention is to reduce the resting radius of can bottoms without necessitating the addition of sequentially performed bottom reforming steps within the can line process.

Another object is to reform can bottoms simultaneously during other can forming steps.

Still another object is to reform the can bottom while simultaneously necking the can open end.

Yet another object is to reform the can bottom without additional conveying.

SUMMARY OF THE INVENTION

A method for reforming a preformed, profiled bottom wall of a container having a side wall extending substantially axially from the bottom wall to define an open end of the container is disclosed. The method comprises the steps of applying a first support to the open end of the container and a second support to a first portion of the container bottom wall. At least one forming finger is then moved into deforming contact with a second portion of the bottom wall so that the second portion is deformed against the counter pressure of the second support acting on the first portion.

The bottom wall includes a preformed central panel. An annular outward conical or radial surface extends downwardly and inwardly from the container side wall toward the central panel. An annular resting radius connects the conical surface to the central panel. The resting radius projects downward from the central panel to define an annular support surface for the container. The resting radius is defined by the first portion which extends upward from the annular support surface to join the central panel and the second portion which is an outwardly concave portion extending upward from the annular support surface to join the side wall through the conical surface. The outwardly concave portion has a radius of curvature R which is reformed by the forming finger to have a reduced radius of curvature r, wherein $r<R$, by being pinched toward said first portion. The curved resting radius and thereby the annular support surface, defined by and between the first and second portions, is tightened to have a reduced radius of curvature to resist unrolling when the container is pressurized with fluid to a predetermined level during normal use.

The forming fingers may extend continuously around the bottom wall to contact substantially the entire periphery thereof. In accordance with an alternate preferred embodiment, however, the forming fingers may be spaced from each other to contact selected portions of the outwardly concave portion to thereby reform the resting radius by tightening it only at the selected portions, with alternating, unselected portions having the non-reformed, larger radius of curvature.

A novel can having the aforementioned alternating reduced and unreduced radius of curvature portions is thereby also disclosed.

In accordance with a preferred feature of this invention, the resting radius is preferably reformed during necking-in of the container open end by contacting the open end with a die forming surface advancing axially toward the open end. This die forming surface is part of a necking spindle assembly mounted to a necking turret of a necking machine. A base pad support assembly mounted on a base pad turret to support the container bottom wall during necking is modified to include the forming fingers to effect simultaneous necking and bottom reforming. In this simultaneous mode of operation, it will be understood that the forming fingers may be substituted with any type of forming member which may be radially inwardly advanced into contact with the bottom wall.

In one embodiment of this invention, the container is non-rotationally supported about its longitudinal axis with said reforming base pad apparatus while static die necking of the container open end occurs.

Apparatus for reforming a preformed, profiled bottom wall of a container having a side wall extending substantially axially from the bottom wall to define an open end of the container is also disclosed. The apparatus comprises an outer housing and a forming anvil mounted within the housing for engaging the bottom wall to support the container on the apparatus. Reforming fingers are mounted within the outer housing for radially inward movement into contact with a portion of the container bottom wall to deform it against the counter pressure of the forming anvil.

A container support member having an annular supporting surface is mounted within the outer housing to engage and support the annular support surface of the container bottom wall between first and second axial positions. In the first axial position, the can supporting member is retracted to locate portions of the bottom wall being reformed into coelevational alignment with the forming anvil and reforming fingers. In the second axial position, the container bottom wall is raised out of the housing where the container is stripped from the apparatus after reforming occurs.

The apparatus further includes control means for coordinating radial movement of the reforming fingers with axial movement of the container support between the first and second positions. The control means preferably includes an actuating ring, mounted for axial movement within the outer housing, and having an inclined, first camming surface engagable with a correspondingly inclined cam follower surface on the reforming fingers. By retracting the actuating ring, the descending first camming surface imparts radially inward reforming movement to the reforming fingers.

A guide bushing extends between the actuating ring and reforming fingers for maintaining concentric alignment between the aforesaid camming surfaces. The actuating ring is normally axially biased into a forward, non-camming position. The outer housing is formed with an annular rearward facing ledge and the actuating ring is formed with an annular forward facing shoulder normally forwardly biased into contact with the ledge. The outer housing is preferably open at front and rear ends thereof. The forming anvil is disposed in the front end and a cam lever mounting plate is attached to close the rear end. Cam mounting portions of the actuating ring extend slidably through the mounting plate to support cam follower rolls which may be engaged by a cam lever that pivots to selectively axially retract and extend the actuating ring into camming and non-camming contact with the reforming fingers.

The cam lever is pivotally mounted to the outer housing. One end of the cam lever is engagable with said cam follower rolls and the other end supports a second cam follower roll engagable with a camming surface. This camming surface may be a cam rail stationarily mounted to a machine frame supporting a base pad turret and a necking turret. A stripper actuating rod extends axially slidably within the forming anvil, through the cam lever mounting plate, for connection to the cam lever. Thereby, the cam lever also controls axial movement of the container support by controlling the axial movement of the stripper rod. Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
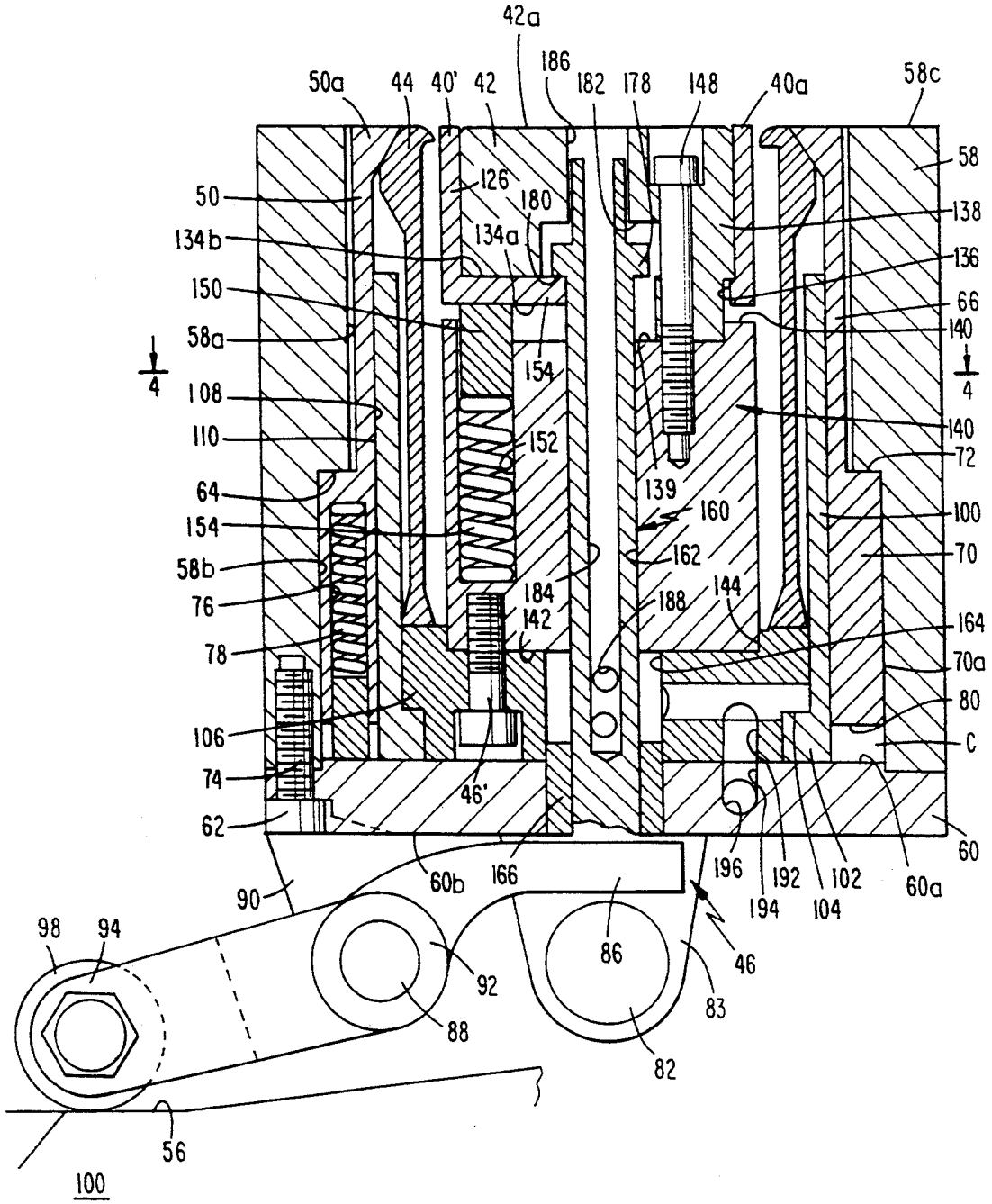
FIG. 1 is a cross-sectional view of a bottom reforming apparatus in accordance with a preferred embodiment of the present invention taken along the line 1—1 of FIG. 4.
Figure 2:
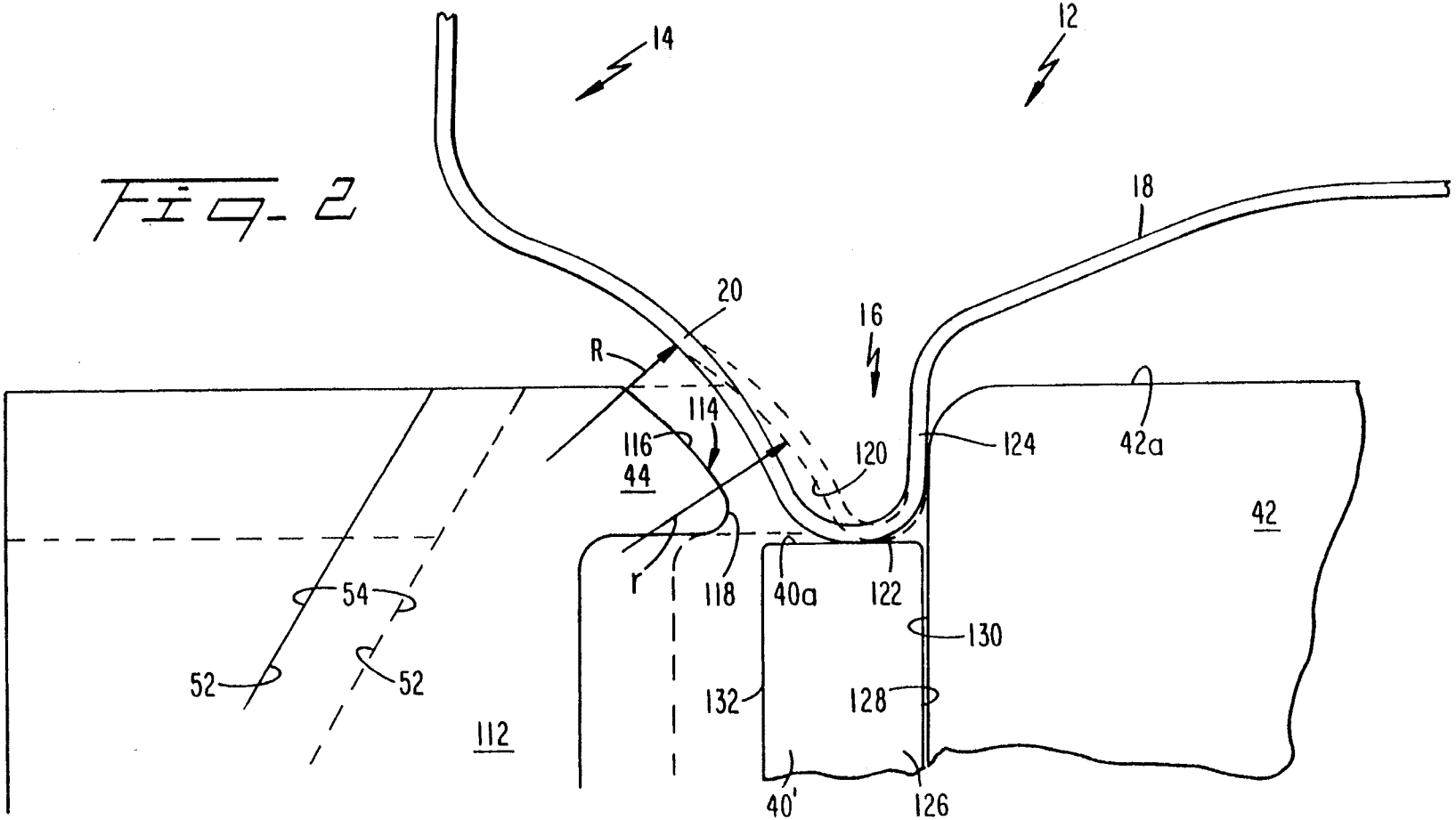
FIG. 2 is an enlarged, partly sectional, partly elevational view depicting the relative positioning of the container bottom wall within the reforming apparatus in the reforming position.

FIGS. 1 and 2 are illustrations of a bottom reforming apparatus 10 for reforming the bottom 12 of a metal beverage can 14 by decreasing the resting radius 16 thereof from about 0.050", for example, to about 0.020" or less. This radial reduction advantageously both increases the internal bulge strength of the can bottom 12 and further reduces the base thickness of metal in the bottom while still maintaining sufficient strength to withstand the internal pressure of product (e.g., beverage) stored in the can of at least 90 psi to ensure integrity of the can when it reaches the consumer.

Known two-piece beverage cans typically require heavier metal thickness in the can bottom and in the side wall to ensure that the can retains its flat resting surface while under pressure. Such beverage containers, including the cans 14 to which the present invention also applies, are typically formed with an inward countersink dome 18 (FIG. 2) and an outward conical or radial surface 20 which are connected by the resting radius 16. The resistance of the inwardly domed portion 18 to outward bulging is greatly influenced by the resting radius 16. The smaller the resting radius 16, the higher the possible internal pressure resistance of the can 14. However, known forming processes for making the aforesaid can bottom 12 work best when the resting radius 16 is large (e.g., 0.050 inches or larger) to ensure that the metal does not fracture or reduce in thickness when it is pulled around this radius on a known forming tool (not shown). Such a large resting radius 16 reduces the internal pressure characteristics of the can 14 since, under high internal pressure, the resting radius tends to "unroll", thereby causing undesirable outward bulging, as aforesaid.

Figure 6:
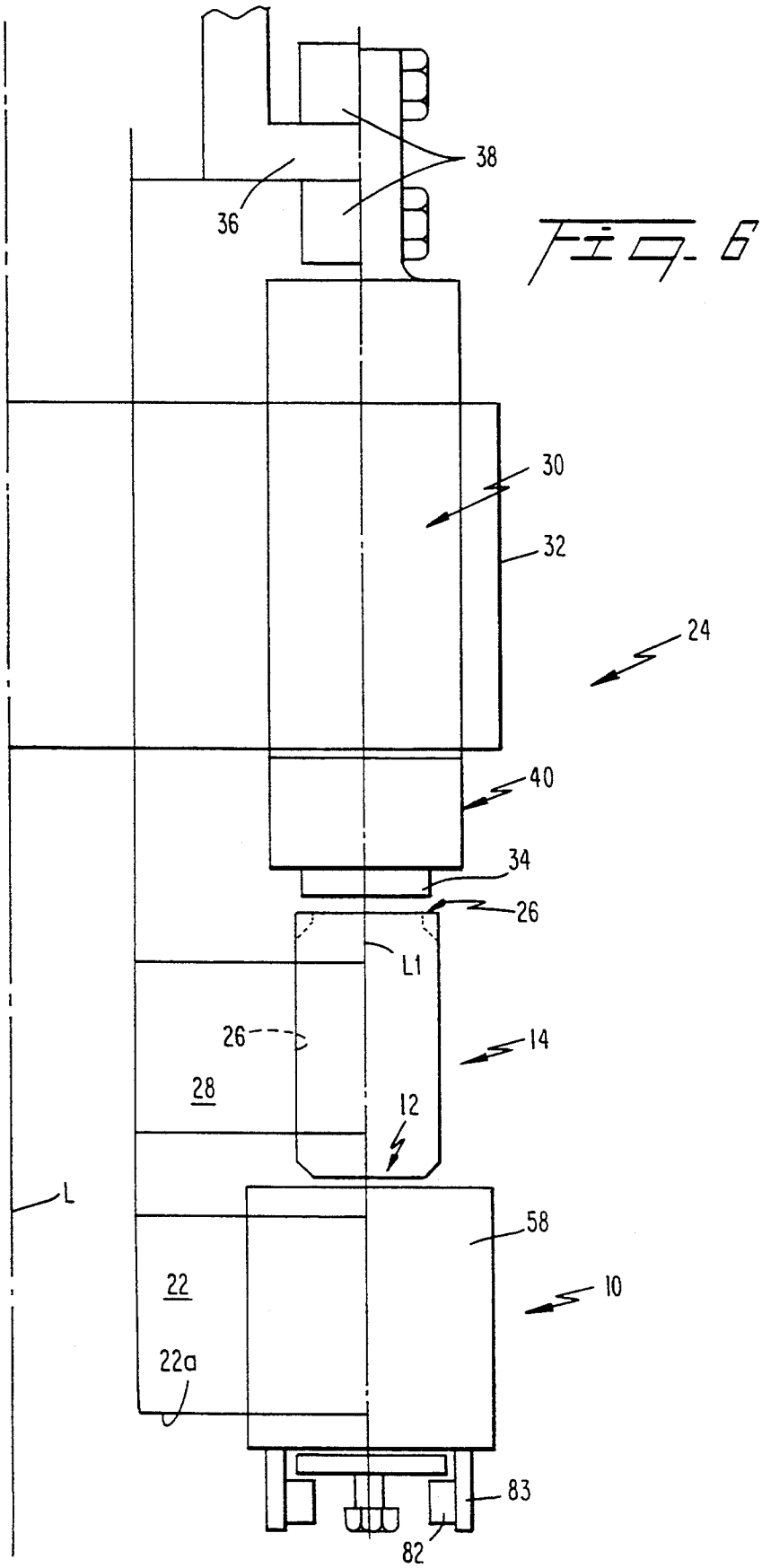
FIG. 6 is a schematic view depicting placement of the bottom reforming apparatus within a necking machine base pad turret assembly for simultaneously necking and bottom reforming of the container.

The bottom reforming apparatus 10 of this invention seeks to reduce the resting radius 16 from the solid line position of FIG. 2 to the phantom line position therein. To accomplish this, apparatus 10 is integrated into the base pad turret 22 (rotatable about an axis L) of a necker machine 24 to supply back support to the can bottom 12 as the open end of the can 14 is necked. As depicted in FIG. 6, the two-piece can body 14 is held in a pocket 26 circumferentially formed in a can support star wheel 28 which is also rotatable about axis of rotation L. A necking spindle assembly 30 is mounted in a necking turret 32 (rotatable about axis L) in coaxial alignment with both the can longitudinal axis L1 (L1 is parallel to L) and the bottom reforming apparatus 10, for co-rotation about axis L therewith. Prior to necking of the open end 26, a pilot assembly 34 in the necking spindle 30 is longitudinally advanced into the can open end 26 under the action of a cam rail 36 (stationarily mounted to a machine support frame (not shown) of the necker 24) engaged by cam follower rolls 38 rotating with the spindle 30 about axis L. After the pilot 34 enters the can open end 26 to a predetermined extent and stops, a necker die assembly 40, coaxially mounted around the pilot assembly in the necking spindle 30, is axially advanced by the cam 36 into necking contact with the open end 26 to form a necked-in diameter depicted in phantom line in FIG. 6.

As the open end 26 is being necked, the can bottom 12 is supported by an axially moveable stripper/can support member 40' disposed in the bottom reforming apparatus 10. In FIG. 2, the can support member 40' has been longitudinally retracted elevationally below an inner forming anvil 42 and outer forming fingers 44 respectively opposing the countersink dome 18 and the outward conical surface 20 of the resting radius 16. A cam follower means 46 used to retract the can support member 40' during the necking operation is interconnected with a second cam follower assembly 48 and, in the unique manner described below, acts as a cam to this second assembly to cause an actuating ring 50 to descend within the bottom reforming apparatus 10. As the actuating ring 50 descends to the phantom line position of FIG. 2, a radially inward inclined camming surface 52 therein engages a correspondingly inclined, radially outward camming surface 54 formed in each of the forming fingers 44 to cause the fingers to radially inwardly advance into forming contact with the outer conical wall 20 in the can bottom. In this manner, the outer conical wall is reformed from the solid line position of FIG. 2 to the phantom line position to effectively reduce the resting radius 16.

As the necking turret 32, can support star wheel 28, and the base pad turret 22 continue their rotation about axis L, the necker die assembly 40 and pilot assembly 34 retract from the necked-in open end 26 of the can 14 under the action of the cam rail on the necker side of the machine. The first and second cam follower arrangements 46, 48 in the bottom reforming apparatus 10, which are acted upon by a stationary cam surface 56 mounted to the machine support frame on the base pad turret side, now operate to return the forming fingers 44 to their radially outward original position. The can support 40' now longitudinally advances into coelevational alignment with the top **42*a* of the forming anvil 42 to enable the necked-in can to be removed from between the necking spindle assembly 30 and the bottom reforming apparatus 10 in a known manner. Details of the necking spindle assembly 30, necking turret 32, star wheel 28, base pad turret 22 and cam 36** are also well known to those skilled in the art and therefore omitted from this disclosure for the sake of simplicity.

Structure of the Bottom Reforming Apparatus

The components of the bottom reforming apparatus 10 are contained within an outer cylindrical retainer housing 58 adapted to be mounted to the periphery of the base pad turret 22 as depicted in FIG. 6. The rear opening of outer housing 58 is closed by a cam arm mounting plate 60 secured to the rear surface of the housing with screws 62. The outer housing 58 may be of constant outer diameter. The forwardly extending portion **58*a* of the inner cylindrical surface thereof is of smaller diameter than the rearwardly extending surface 58*b* to define a rear facing annular stop surface 64 in an intermediate portion thereof. This stop surface 60 limits forward movement of actuating ring 50**.

The actuating ring 50 is mounted immediately radially inwardly adjacent the housing 58. The actuating ring 50 includes a forwardly extending smaller diameter cylindrical portion 66 having an outer cylindrical surface 68 spaced slightly radially inwardly from the inner cylindrical surface **58*a* of the outer housing 58 located forwardly of the stop surface 64. The rearwardly extending cylindrical portion 70 of the actuating ring 50 is of larger outer diameter than the forwardly extending portion 66 thereof (but of constant inner diameter) and has an outer cylindrical surface 70*a* in sliding engagement with the inner cylindrical surface 58*b* of the housing 58 extending rearwardly from the stop 64. The smaller and larger diameter portions 66, 70 of the actuating ring 50 define a forwardly facing shoulder 72 adapted to abut against the rearward facing stop surface 64 in the forwardmost position of the actuating ring. In this forwardmost non-actuating position (e.g., FIG. 1), the front edge 50*a* of the actuating ring 50 is flush with the front surface 58*c* of the housing 58 as well as the front surfaces 42*a*, 44*a* of the forming anvil 42 and forming fingers 44, respectively. The actuating ring 50 is normally biased into this forwardmost position by means of a return spring plunger 74 which projects rearwardly from a cylindrical blind bore 76 extending axially within the enlarged diameter rear portion 70 of the actuating ring. This blind bore 76 contains a compressed spring 78 urging the return spring plunger 74 rearwardly against mounting plate 60 to impart resilient forward bias to the actuating ring 50**.

Figure 3:
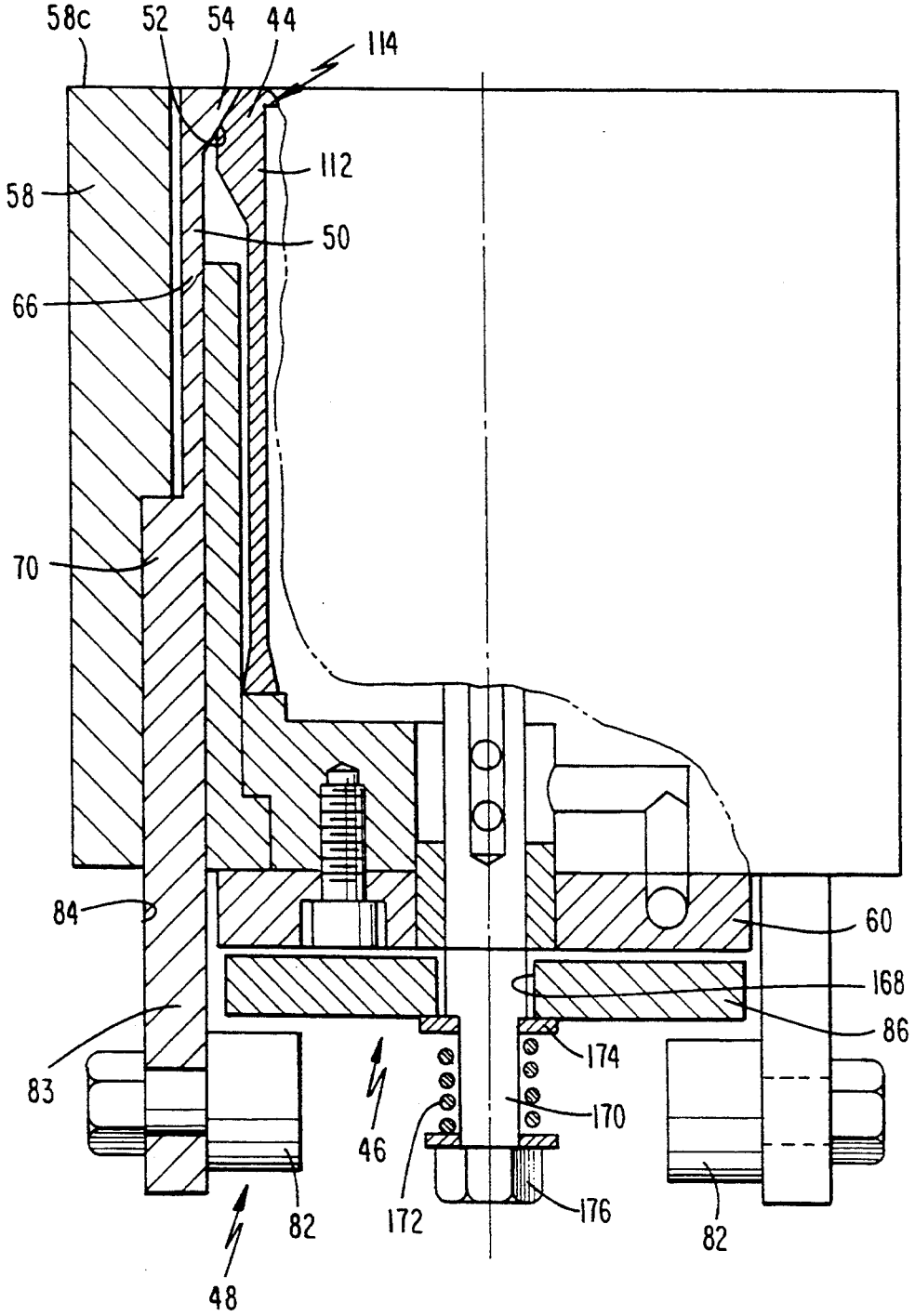
FIG. 3 is a partly sectional, right side elevational view of the apparatus to depict the camming control arrangement for this invention.
Figure 5:
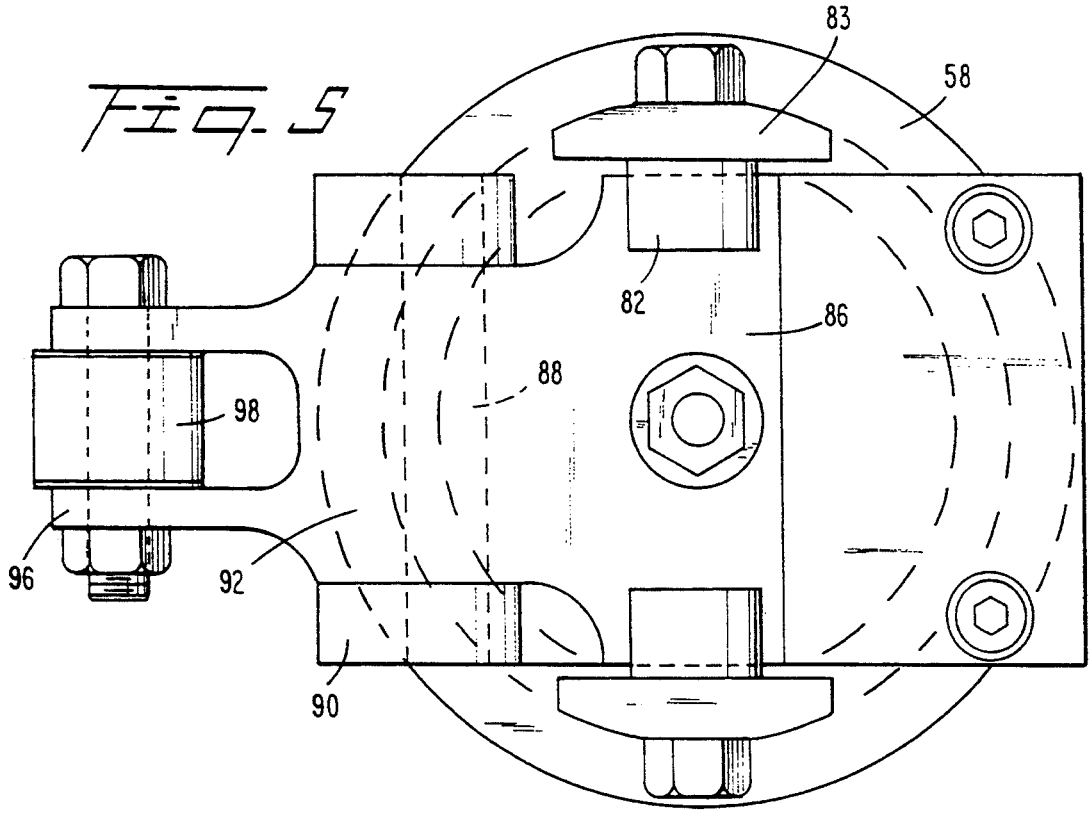
FIG. 5 is a bottom plan view of the reforming apparatus of FIG. 1.

The actuating ring 50 is reciprocable between camming and rest positions by forming the axial length of the larger diameter rearwardly extending portion 70 thereof less than the distance between the rear facing stop 64 and the inner surface of the mounting plate 60. This provides clearance C between the rear surface 80 of the actuating ring 50 and the inner surface **60*a* of the mounting plate 60 to enable retraction of the actuating ring under camming contact imparted to it through a pair of cam follower rolls 82 (i.e., second cam follower arrangement 48) respectively mounted to diametrically opposite lobes 83 of the actuating ring extending downwardly through apertures 84 in the mounting plate 60. As best depicted in FIGS. 1, 3 and 5, the cam followers 82 are acted upon through cam lever 46 having a distal working end 86 extending between the outer surface 60*b* of the mounting plate 60 and the cam followers. The fulcrum for the cam lever 46 is defined by a pivot pin 88 having opposite ends mounted within a pair of parallel spaced mounting ears 90 welded to the outer surface 60***b* of the mounting plate 60. This pivot pin 88 extends through a hub portion 92 formed in the cam lever 46 intermediate opposite ends thereof. The cam follower lever 46 curves upwardly from the hub portion 92 to define the distal working end 86 (FIG. 1). The opposite end portion 94 of the cam lever 46 includes a pair of parallel spaced arms 96 receiving a cam follower 98 therebetween. This cam follower 98 is adapted to ride along the cam surface 56 of a stationary cam rail 100 mounted to the machine frame (not shown) of the necker 24 in opposing relation to the rear face 22*a* of the base pad turret 22. Thus, during co-rotation of the base pad turret 22 and necking turret 32, the axial spacing of the cam surface 56 relative to the fulcrum 88 will vary to thereby pivot the cam lever 46 about the fulcrum.

To reform the can bottom, as will be seen below, the working end 86 of the cam lever 46 is rotated clockwise (FIG. 1) about the fulcrum 88 and away from the mounting plate 60. As this occurs, the working end 86 contacts the actuating ring cam follower rolls 82 to depress the lobes 83 (away from the mounting plate 60) and thereby cause retraction of the actuating ring 50 against the bias of the return spring 78. After reforming, the actuating ring 50 is returned to its forward rest position by counterclockwise rotation of the cam lever 46 which pivots the working end 86 back toward the mounting plate 60 and out of contact with the actuating ring cam followers 82. The return spring 78 urges the shoulder 72 of the actuating ring forwardly against the stop ledge 64 so as to achieve the forward non-actuating position.

The forwardmost portion 66 of the actuating ring 50 is formed with the inclined camming surface 52 engaging the correspondingly inclined camming surface 54 formed in a radially outward forwardmost portion of each forming finger 44. The actuator ring camming surfaces 52 are maintained in concentric alignment with the forming finger camming surfaces 54 through a cylindrical guide bushing 100 mounted between the actuator ring 50 and the radially inwardly adjacent bottom reforming tool 44. The rearwardmost portion of the guide bushing contains a radially inwardly extending locating flange 102 engageable with a corresponding stop 104 formed in the base 106 of the forming tool which retains the bushing in an axially stationary position. During retraction of the actuating ring 50 by the cam lever 46 and actuating arrangement 98, 88, 86, 82 described above, the inner cylindrical surface 108 of the actuating ring slides along the outer cylindrical surface 110 of the guide bushing 100 which keeps the actuating ring and thereby the camming surfaces 52 centered.

As mentioned above, the forming tool 44 includes the cylindrical base section 106 engaging the radially outwardly located guide bushing 100. In one preferred embodiment, the forming fingers 44 are axially formed by making a series of circumferentially spaced radial saw cuts 110 (FIG. 4) in a cylindrical side wall projecting upwardly from and integral with the base 106. The saw cuts 110 thus terminate at the base 106 and the distal ends 112 of the resulting forming fingers 44 are thereby sufficiently springy so as to be pivotal relative to the base.

The actual forming surface 114 of each forming finger 44, as best depicted in FIG. 2, is located on a radially inward side of the distal end 112 opposite the inclined camming surface 54 formed on the radially outward side thereof. In one embodiment, the front surface 44*a* of each axially stationary forming finger 44 is flat and flush with the radially inwardly spaced front surface 42*a* of the forming anvil 42. The radially inwardly extending convex forming surface 116 which extends from the front surface 44*a* towards the forming anvil 42 has a radius of curvature adapted to correspond to the desired curvature which is to be imparted to the outward conical surface 20 of the resting radius 16. This forming surface 116 terminates in a nose 118 which defines the intersection between the reduced resting radius 120 and the bottommost curved portion 122 of the can bottom 12 on which the can 14 rests.

As mentioned above, the bottommost portion 122 of the resting radius rests upon the uppermost surface 40*a* of the cylindrical can support member 40'. This can support member 40' extends between the radially inward forming anvil 42 and radially outward forming fingers 44. During forming, the uppermost surface 40*a* of the can support member is retracted below the uppermost surfaces 42*a*, 44*a* of the forming anvil 42 and forming fingers 44 to thereby locate the countersink 124 in supported abutting contact with the forming anvil 42 and the outer conical section 20 of the resting radius 16 in opposing relation to the forming tool surface 114 so as to be pinched and reformed thereby.

More specifically, with reference to FIGS. 1 and 2, the can support member 40' includes a cylindrical side wall 126 having an inner cylindrical surface 128 slidable along the axially stationary outer cylindrical surface 130 of the forming anvil 42. The outer cylindrical surface 132 of the can support side wall 126 is spaced from the forming fingers 44 to permit radially inward forming movement. The cylindrical side wall 126 terminates rearwardly in a bottom wall 134 (FIG. 1) provided with a pair of diametrically opposed kidney shaped openings 136. A pair of correspondingly shaped feet 138 in the forming anvil 42 respectively project downwardly through the openings 136 into abutting contact with the top surface 139 of a cylindrical spring holder 140 having a bottom surface 142 nesting within a cylindrical recess 144 formed in an upper surface of the forming tool base 106. The cylindrical spring holder 140 is bolted into the cylindrical recess 144 of the forming tool base 106 by means of screws 46' to supply the forming anvil 42 while limiting retraction of the can support 40' in the manner described below.

The forming anvil 42 is bolted to the top surface 139 of the spring holder 140 by means of a pair of bolts 148 extending respectively through each of the anvil feet 138 through counter board openings in the top surface 42*a* of the anvil. A pair of spring plungers 150 are respectively mounted in diametrically opposing relation to each other between the anvil feet 138 to press upwardly against the bottom surface 134*a* of the can support bottom wall 134. These spring plungers 150 are respectively disposed within longitudinally extending blind bores 152 in the spring holder 140. A pair of springs 154 respectively received in these bores 152 serve to resiliently bias the plungers 150 upwardly against the bottom surface 134*a* of the can surface bottom wall 134 and, in this manner, to resiliently bias the can support 40' so that the uppermost surface 40*a* thereof is normally coplanar with the uppermost surfaces 44*a* and 42*a* of the forming tool 44 and anvil 42. In this position, the bottom surface 134*a* of the can support bottom wall 134 is spaced from the top surface 140*a* of the spring holder 140. As will be seen below, this top surface 140*a* acts as a stop surface which limits the extent to which the can support 40' retracts below the forming anvil top surface 42*a* to accurately locate the resting radius 16 in proper reforming position.

The can support member 40', in its retracted or lowermost position of FIG. 2, serves to support the can bottom 12 during the necking process while properly locating the resting radius 16 (R) in a position to be pinched and thereby reformed by the forming fingers 44 as described more fully below. After reforming occurs, the can support member 40' is advanced to its raised position so that the uppermost surface 40*a* thereof is now flush with the top surfaces 44*a*, 42*a* of the forming fingers 44 and forming anvil 42. In this position, the can support member 40' acts as a stripper enabling the can 14 to be removed from between the base pad and necking turrets 22, 32 for subsequent operations.

Raising and lowering of the can support member 40' is achieved through an actuating rod 160 extending longitudinally through a central passageway 162 formed in the spring holder 140. With reference to FIG. 3, the actuating rod 160 extends downwardly from the spring holder 140 through a central throughbore 164 formed in the forming tool base section 106 and then through a bushing 166 disposed in a central rear opening of the cam arm mounting plate 60. The lowermost end of the actuating rod 160 extends downwardly from the mounting plate 60, through an opening 168 formed in the distal working end 86 of the cam lever 46, and includes a reduced diameter portion 170 projecting downwardly from the cam lever. A spring 172 is mounted to the reduced diameter portion 170 to press against a washer 174 encircling the reduced diameter portion between the spring and the lever 46. The outer diameter of the washer 174 is greater than the diameter of the opening 168 in the lever 46 through which the actuating rod 160 projects and the inner diameter of the washer corresponds to the outer diameter of the reduced diameter portion 170. The opposite end of the spring 172 is captivated by a nut 176 threaded to the lowermost end of the actuating rod 160. As will be seen more fully below, this spring 172 creates a pre-load force acting through the actuating rod 160 to resiliently bias, during retraction, the bottom surface 134*a* of the can support bottom wall against the top surface 140*a* of the spring holder 140 to maintain the can support member 40' in its retracted forming position.

With reference to FIG. 1, the upper portion of the actuating rod 160 extending through and above the can support bottom wall 134 includes an enlarged diameter portion 178 having a downward facing drive surface 180 adapted to engage the upward facing surface 134*b* of the bottom wall during retraction in the manner described below. This enlarged diameter portion 178 is disposed within a cylindrical recess 182 formed in the bottom surface of the anvil 42 and is of lesser height than the recess depth to enable upward lifting movement of the actuating rod 160 and thereby separation of the actuating rod drive surface 180 from the can support driven surface 134 during raising of the can support 40 under the upward resilient bias of the spring plungers 150.

The actuating rod 160 is further formed with a longitudinally extending vacuum passageway 184 which is in communication with the top surface 42*a* of the anvil 42 through a central opening 186 in the anvil in coaxial alignment with the vacuum passageway. The uppermost end of the rod 160 is received in the opening 186. With reference to FIGS. 1 and 2, this vacuum passageway 184 is adapted to supply vacuum to the underside of the dome 18 to suck the can bottom 12 against the can support surfaces 40*a* during the necking and reforming process. The vacuum passageway 184 communicates with a source of vacuum (not shown) through a transversely extending bore 188 formed in a lower portion of the actuating rod 160, in communication with an annular chamber defined by the central opening 164 in the forming tool base 106 through which the actuating rod extends. This annular chamber 164 in turn communicates with a transverse passageway 190 formed in the forming tool base 106 which intersects a longitudinal passageway 192 in the forming tool base aligned with a further longitudinal passageway 194 in the mounting plate 60. A transverse passageway 196 in the mounting plate 60 provides final communication from the bottom reforming apparatus 10 to the vacuum source in a manner which will now occur to one of ordinary in the art.

Operation of the Bottom Reforming Apparatus

Bottom reforming apparatus 10 operates as follows. As mentioned above, the apparatus 10 is mounted into the base pad turret 22 in coaxial alignment with the necking spindle assemblies 30 and is cam actuated (cam 100) as the necking turret 32 revolves while necking the can 14. The can 14 is initially fed in about 0.030" above the top surface 42*a* of the forming anvil 42. At this point, the camming surface 56 has moved the cam follower 98 and cam lever 46 so that the stripper actuating rod 160 is pulled downwardly away from the can 14 by the lever working end 86, thereby retracting the can supporting surface 40*a* about 0.125" below the top surface 42*a* of the forming anvil 42 as best depicted in FIG. 2. The can supporting member 40' has been moved as far down as it can go since the rear bottom surface 134*a* of the can supporting member now rests on the top surface of 140*a* the spring holder 140. The pre-load force of the spring 172 mounted to the stripper actuating rod 160 holds the can supporting member 40 downwardly against the spring holder 140.

The can 14 is now fed into the necking station and the necking tooling 34, 40 starts to move down on the can. The air blowing out of the necking tooling tends to blow the can 14 toward and onto the forming anvil 42. Vacuum is supplied through the longitudinal vacuum passageway 184 which will suck air out from between the top surface 42*a* of the forming anvil 42 and the dome surface 18 of the can bottom 12 which serves to firmly secure the can rest radius 16 down on the top surface 40*a* of the can supporting member 40' so that the resting radius is in proper elevational location (FIG. 2) to be reformed by the forming fingers 44.

Eventually the necking die 40 will close on the open end 26 of the can 14 which seals off the open end and allows build-up of air pressure inside the can. This pressure build-up will force the can bottom radius 16 hard against the can support 40'. This air pressure force could be from about 25 pounds to 160 pounds depending upon the operating conditions of the necker 24.

The necking die member 40 now starts to neck in the open end 26 of the can 14 to reduce its diameter. This metal reforming also produces an axial load on the can 14 which can be as little as 150 pounds to as much as 300 pounds. This additional axial load, added to the air pressure load, means that the can 14 is held against the can support member 40' with as little as 175 pounds to as much as 360 pounds depending on operating conditions of the necker 24. This magnitude of axial load ensures that the can 14 will not move out of position while the forming fingers 44 reform the can bottom 12. It is theorized that this high axial load on the can 14 during the time the bottom 12 is being reformed might also produce a sharper radius 120 in the corner disposed between the can support 40' and the forming anvil 42.

After the can 14 is in place and the necking load is applied, the forming action takes place. More specifically, the cam follower 98 rolls to a rising portion on the camming surface 56 which in turn rotates the cam lever 46 into descending contact with the actuating ring cam followers 82. This pressing contact occurs after the initial movement of the cam lever 46 moves the stripper actuating rod 160 to initially retract the can support member 40'. As the underside of the cam lever 46 contacts the actuating ring cam followers 82, the cam followers are lowered which in turn pulls the actuating ring 50 downwardly. As this occurs, the inner cylindrical surface 108 of the actuating ring 50 slides on the outer cylindrical surface 110 of the guide bushing 100 which maintains the camming surfaces 52 of the actuating ring properly centered. This camming or conical surface 52 now moves away from the can 14 and, by contacting the corresponding conical camming surface 54 on the forming fingers 44, forces the multiplicity of forming fingers (i.e., forming surfaces 114) radially inwardly into the can bottom surface 20 to reform the resting radius 16 (r) against the forming anvil 42 in the manner described above.

As the cam follower 98 reaches its highest point on the stationary camming surface 56, the forming fingers 44 reach their radially innermost position in reforming contact with the can resting radius 16. The stationary camming surface 56 then drops away which causes the cam follower 98 to descend. This in turn pivots the cam lever working end 86 in the counterclockwise direction, out of contact with followers 82, allowing the actuating ring return spring 78 to lift the actuating ring 50 to its uppermost position depicted in FIG. 1 where the actuating ring shoulder 72 contacts the downward facing stop surface 64 in the outer housing 58 against the bias of the return spring. The forming fingers 44 are now back to their original position but the can support member 40' is still maintained in its retracted position until the necking operation is completed and the necking die 40 is retracted just clear of the necked-in open can end 26 so that the compressed air in the can interior is released. The stationary camming surface 56 now drops away which causes further counterclockwise rotation of the cam lever working end 86 back towards the mounting plate 60 which allows the can supporting member 40 to move up under the resilient action of the spring 154 and plunger 150 until the bottom wall **134*b* of the can supporting member contacts the bottom surface of the forming anvil 42 so that the top surface 40*a* of the can support is slightly above the top surface 42*a* of the anvil. In this manner, the reformed can bottom radius 120 is now raised out of the forming cavity (defined between the forming tool 44, forming anvil 42 and the retracted position of the can support uppermost surface 40*a* in FIG. 2**) to its original feed level so that it can be stripped out to the next operation.

Preferably, light vacuum is still applied to the underside of the dome 18 during this lifting operation to ensure that the can 14 does not pop up too fast and drift uncontrolled into the necking die 40.

After the can 14 is stripped out of this station, the stationary camming surface 56 now forces the cam follower 98, cam lever 46 and the stripper actuating rod 160 to pull the can support 40' down to the position depicted in FIG. 1. The bottom reforming apparatus 10 of this invention is now ready to accept another can 14 for reforming in the manner described above.

A potential problem occurring with the reformed bottom formed in the manner described above is the sharp corner cutting through the carton material during shipping since the resting surface 120, 122 of reduced radius is thereby sharp around the entire periphery of the can bottom 12. Therefore, in accordance with a second embodiment of this invention, selected ones of the forming fingers 44 are removed from the forming tool so that the resulting modified forming tool will not reform by reducing the radius of the entire can bottom but would instead reform by reducing the radius of a number of circumferentially spaced selected points only. For example, it may be desirable to reform 12 portions of the resting radius which are each ¼" wide, leaving 12 segments unreformed alternately between the reformed segments. This resulting arrangement would add strength to the bottom but would also leave about ½ of the rest radius with a large (unreformed) radius to reduce the indentation into the paper carton.

Figure 4:
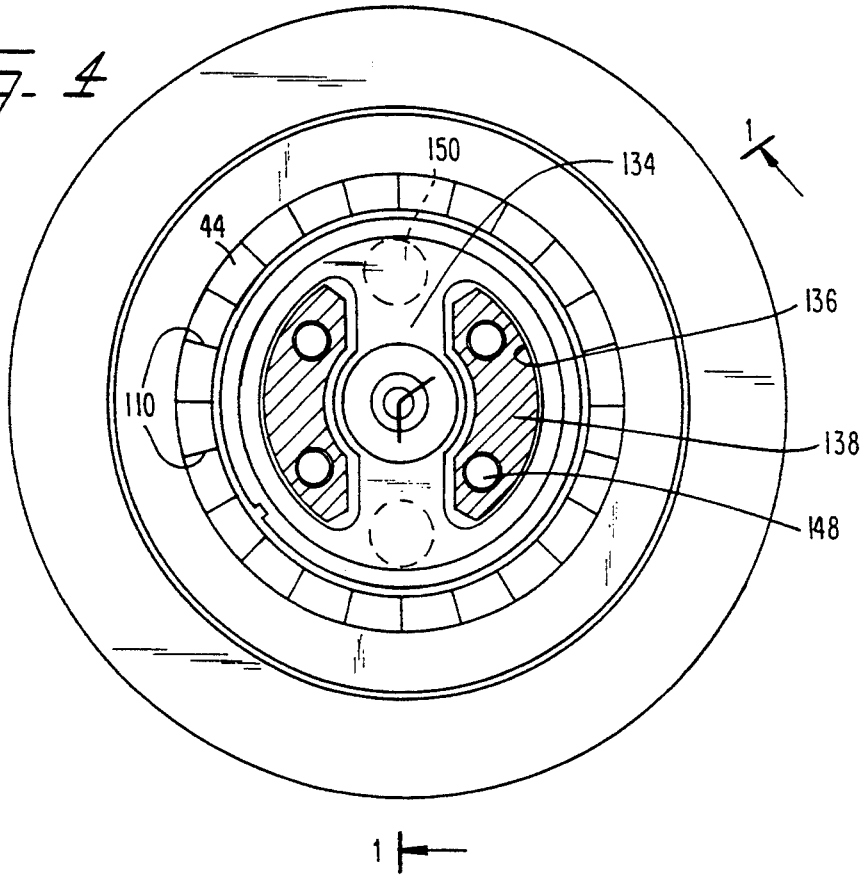
FIG. 4 is a sectional view taken along the line 4—4 of FIG. 1.
Figure 7:
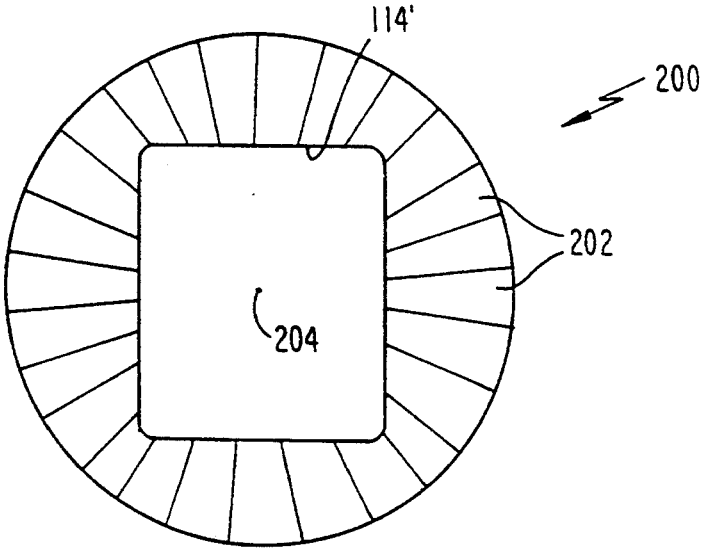
FIG. 7 is a bottom plan view of an alternate embodiment of plural forming fingers contactable with a preformed, profiled container bottom wall of corresponding rectangular cross-section in plan view.

FIG. 7 is an illustration of a second embodiment wherein a plurality of forming fingers 200 are depicted in a radially inwardly displaced condition for reforming contact with a can resting radius which is of rectangular configuration in plan view. In this embodiment, the plural forming fingers 200 may be formed in a manner similar to forming fingers 112 to the extent that the individual forming fingers 202 of FIG. 7 project upwardly from a base section 106 and present arcuate outer surfaces to jointly define an outer cylindrical cross-section to be acted upon by the actuating ring 50 in the FIG. 2 embodiment. However, to act upon a can resting radius of square or rectangular configuration in plan view, each of the individual fingers 202 are of different length, as a function of their relative angular location about center 204, and present actual forming surfaces 114' which are similar to surfaces 114 in the FIG. 2 embodiment. However, instead of being of arcuate configuration as depicted in FIG. 4, these forming surfaces 114' jointly define a configuration of rectangular or square cross-section (or other geometric shape) when the forming fingers 202 are cammed into their radially inward spaced locations depicted in FIG. 7 to contact and reduce the resting radius of the can. Once camming contact with actuating ring 50 is released, these fingers 202 will return to their radially outwardly located rest positions (not shown).

In this FIG. 7 embodiment, can support 40 will have a configuration in plan view corresponding to the rectangular or square configuration depicted in FIG. 7 instead of the cylindrical configuration of FIG. 4.

It will now appreciated that the feature of forming the fingers 202 in the manner depicted in the FIG. 7 embodiment advantageously enables the fingers to reduce the rest radius of a profiled can bottom wall of square or rectangular cross-section in plan view, or virtually any other geometric shape in plan view, by suitably forming the radially inward surfaces 114' of each forming finger so that the resulting overall forming surfaces presented by the forming fingers, when radially inwardly displaced into camming contact with the container bottom wall, will define said rectangular, square or other geometric shape in plan view. By forming the outer surfaces of the fingers 202 to present a cylindrical configuration, the same components of the bottom reforming apparatus depicted in FIG. 2, with the exception of the forming fingers, can support and forming anvil as will now occur to one of ordinary skill in the art, may be utilized with the FIG. 7 embodiment to act upon cans of other shapes.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

I claim:

1. A method for reforming a preformed, profiled bottom wall of a container having a side wall extending substantially axially from the bottom wall to define an open end of the container, comprising the steps of:

a) applying a first support in the form of a necking spindle assembly into the open end of the container, said necking spindle assembly including a necker die assembly;

b) applying a second support to a first portion of said bottom wall;

c) advancing the necker die assembly into necking contact with said open end to form a necked-in diameter therein; and d) moving at least one forming finger into deforming contact with a second portion of the bottom wall, as said open end is being necked, so that said second portion is deformed against the counter pressure of the second support acting on said first portion, wherein said bottom wall includes a preformed central panel, an annular outward conical or radial surface extending downwardly and inwardly from the side wall toward the central panel, and an annular resting radius connecting the conical surface to the central panel, said resting radius projecting downward from the central panel to define an annular support surface for the container, said resting radius being defined by said first portion which extends upward from the annular support surface to join the central panel and said second portion which is an outwardly concave portion extending upward from the annular support surface to join the side wall, said outwardly concave portion having a radius of curvature R, which is reformed by said at least one forming finger to have a reduced radius of curvature r, wherein $r<R$, by being pinched toward said first portion so that the annular resting radius and thereby the annular support surface defined by and between the first and second portions is tightened to have a reduced radius of curvature to resist unrolling when the container is pressurized with fluid to a predetermined extend for normal use, wherein a plurality of forming fingers extend continuously around the bottom wall to contact substantially the entire periphery thereof.

2. A method for reforming a preformed, profiled bottom wall of a container having a side wall extending substantially axially from the bottom wall to define an open end of the container, comprising the steps of:

a) applying a first support in the form of a necking spindle assembly into the open end of the container, said necking spindle assembly including a necker die assembly;

b) applying a second support to a first portion of said bottom wall;

c) advancing the necker die assembly into necking contact with said open end to form a necked-in diameter therein; and d) moving at least one forming finger into deforming contact with a second portion of the bottom wall, as said open end is being necked, so that said second portion is deformed against the counter pressure of the second support acting on said first portion, wherein said bottom wall includes a preformed central panel, an annular outward conical or radial surface extending downwardly and inwardly from the side wall toward the central panel, and an annular resting radius connecting the conical surface to the central panel, said resting radius projecting downward from the central panel to define an annular support surface for the container, said resting radius being defined by said first portion which extends upward from the annular support surface to join the central panel and said second portion which is an outwardly concave portion extending upward from the annular support surface to join the side wall, said outwardly concave portion having a radius of curvature R, which is reformed by said at least one forming finger to have a reduced radius of curvature r, wherein $r<R$, by being pinched toward said first portion so that the annular resting radius and thereby the annular support surface defined by and between the first and second portions is tightened to have a reduced radius of curvature to resist unrolling when the container is pressurized with fluid to a predetermined extend for normal use, wherein a plurality of forming fingers are circumferentially spaced from each other to contact selected portions of said outwardly concave portion to thereby reform the resting radius by tightening it only at said selected portions.

3. A method for reforming a preformed, profiled bottom wall of a container having a side wall extending substantially axially from the bottom wall to define an open end of the container, comprising the steps of:

a) applying a first support in the form of a necking spindle assembly into the open end of the container, said necking spindle assembly including a necker die assembly;

b) applying a second support to a first portion of said bottom wall;

c) advancing the necker die assembly into necking contact with said open end to form a necked-in diameter therein; and d) moving at least one forming finger into deforming contact with a second portion of the bottom wall, as said open end is being necked, so that said second portion is deformed against the counter pressure of the second support acting on said first portion, wherein said bottom wall includes a preformed central panel, an annular outward conical or radial surface extending downwardly and inwardly from the side wall toward the central panel, and an annular resting radius connecting the conical surface to the central panel, said resting radius projecting downward from the central panel to define an annular support surface for the container, said resting radius being defined by said first portion which extends upward from the annular support surface to join the central panel and said second portion which is an outwardly concave portion extending upward from the annular support surface to join the side wall, said outwardly concave portion having a radius of curvature R, which is reformed by said at least one forming finger to have a reduced radius of curvature r, wherein $r<R$, by being pinched toward said first portion so that the annular resting radius and thereby the annular support surface defined by and between the first and second portions is tightened to have a reduced radius of curvature to resist unrolling when the container is pressurized with fluid to a predetermined extend for normal use, comprising the further steps of:

i) advancing the container into a location between a first turret and a base pad turret, the first turret containing the first support and the base pad turret containing the second support, said first and second supports being coaxially aligned with the longitudinal axis of the container;

ii) holding the container bottom against the second support means by applying vacuum through a forming anvil of the second support to the underside of the raised central panel, said forming anvil engaging said first portion;

iii) axially supporting the resting radius by contacting the annular support surface with an annular can support surface extending around the forming anvil;

iv) radially inwardly deflecting said at least one forming finger into deforming contact with said second portion while the first portion is supported by the anvil in fixed radially inward spaced coelevational relationship to the second portion and the annular support surface is axially supported as in step iii;

v) advancing the container, after the reforming step iv, towards the first support by raising the container support surface towards the first support; and vi) removing the container from between the turrets.

4. The method of claim 3, wherein the first support includes said necking spindle assembly mounted to the first turret which is a necking turret, and comprising the steps of reforming said resting radius during necking in of the container open end by contacting said open end with a die forming surface advancing axially towards said open end.

5. The method of claim 4, comprising the further step of rotating the first turret and base pad turret with the container about a common axis of rotation during steps ii) through vi) of claim 3, said common axis being generally parallel to the container axis, and providing the movement to said at least one forming finger in step iv) and to said container support surface in step v) through camming arrangements responsive to cam followers rotating with the base pad turret in contact with a stationary camming surface located adjacent said base pad turret.

6. The method of claim 4, wherein said container is non-rotational about its longitudinal container axis while said at least one reforming finger is applied to the container bottom wall.

7. The method of claim 5, wherein said reforming finger is axially stationary and supported in the base pad turret so as to be pivotally, radially inwardly flexed into contact with the container bottom.

8. A method for reforming a preformed, profiled bottom wall of a container having a side wall extending substantially axially from the bottom wall to define an open end of the container, comprising the steps of:

a) applying a first support into the open end of the container;

b) applying a second support to a first portion of said bottom wall; and c) moving at least one forming finger into deforming contact with a second portion of the bottom wall so that said second portion is deformed against the counter pressure of the second support acting on said first portion, wherein the first support includes a necking spindle assembly mounted to a necking turret, and comprising the further step of reforming the profiled bottom wall during necking in of the container open end by contacting said open end with a die forming surface of the necking spindle assembly advancing axially towards said open end, wherein said bottom wall includes a preformed central panel, an annular outward conical or radial surface extending downwardly and inwardly from the side wall toward the central panel, and an annular resting radius connecting the conical surface to the central panel, said resting radius projecting downward from the central panel to define an annular support surface for the container, said resting radius being defined by said first portion which extends upward from the annular support surface to join the central panel and said second portion which is an outwardly concave portion extending upward from the annular support surface to join the side wall, said outwardly concave portion having a radius of curvature R, which is reformed by said at least one forming finger to have a reduced radius of curvature r, wherein $r<R$, by being pinched toward said first portion so that the curved resting radius and thereby the annular support surface defined by and between the first and second portions is tightened to have a reduced radius of curvature to resist unrolling when the container is pressurized with fluid to a predetermined extend for normal use, wherein said at least one forming member includes a plurality of forming fingers and wherein a plurality of forming fingers extend continuously around the bottom wall to contact substantially the entire periphery thereof.

9. A method for reforming a preformed, profiled bottom wall of a container having a side wall extending substantially axially from the bottom wall to define an open end of the container, comprising the steps of:

a) applying a first support into the open end of the container;

b) applying a second support to a first portion of said bottom wall; and c) moving at least one forming finger into deforming contact with a second portion of the bottom wall so that said second portion is deformed against the counter pressure of the second support acting on said first portion, wherein the first support includes a necking spindle assembly mounted to a necking turret, and comprising the further step of reforming the profiled bottom wall during necking in of the container open end by contacting said open end with a die forming surface of the necking spindle assembly advancing axially towards said open end, wherein said bottom wall includes a preformed central panel, an annular outward conical or radial surface extending downwardly and inwardly from the side wall toward the central panel, and an annular resting radius connecting the conical surface to the central panel, said resting radius projecting downward from the central panel to define an annular support surface for the container, said resting radius being defined by said first portion which extends upward from the annular support surface to join the central panel and said second portion which is an outwardly concave portion extending upward from the annular support surface to join the side wall, said outwardly concave portion having a radius of curvature R, which is reformed by said at least one forming finger to have a reduced radius of curvature r, wherein $r<R$, by being pinched toward said first portion so that the curved resting radius and thereby the annular support surface defined by and between the first and second portions is tightened to have a reduced radius of curvature to resist unrolling when the container is pressurized with fluid to a predetermined extend for normal use, wherein said at least one forming member includes a plurality of forming fingers and wherein a plurality of forming fingers are circumferentially spaced from each other to contact selected portions of said outwardly concave portion to thereby reform the resting radius by tightening it only at said selected portions.

10. Apparatus for reforming a preformed, profiled bottom wall of a container having a side wall extending substantially axially from the bottom wall to define an open end of the container, comprising:

a) a forming anvil mounted for engaging said bottom wall to support said container on said apparatus; and b) forming finger means radially inwardly movable into contact with a portion of the bottom wall to deform it against the counter pressure of the forming anvil, wherein said bottom wall includes a preformed central panel and an annular resting radius connecting the side wall to the central panel, said resting radius projecting downward from the central panel to define an annular support surface for the container, said resting radius being defined by a first portion which extends upward from the annular support surface to join the central panel and a second portion which is an outwardly concave portion extending upward from the annular support surface to join the side wall, said outwardly concave portion having a radius of curvature R, which is reformed by said at least one forming finger to have a reduced radius of curvature r, wherein $r<R$, by being pinched toward said first portion so that the curved resting radius and thereby the annular support surface defined by and between the first and second portions is tightened to have a reduced radius of curvature to resist unrolling when the container is pressurized with fluid to a predetermined extend for normal use, further comprising means, engageable with the annular support surface, for supporting the container at a first axial position where reforming occurs and at a second axial portion where the container is stripped from the apparatus, further comprising control means for coordinating radial movement of the forming finger means with axial movement of the container supporting means, wherein said control means includes actuating ring means, mounted for axial movement within an outer housing, and including a first camming surface engageable with a cam follower surface on the forming finger means, whereby axial movement of the actuating ring means causes the first camming surface to press against the cam follower surface and thereby radially inwardly deflect said forming finger means into reforming contact with the bottom wall.

11. Apparatus of claim 10, further comprising guide bushing means between the actuating ring means and the forming finger means for maintaining concentric alignment between the first camming surface and the cam follower surface.

12. Apparatus of claim 10, wherein said actuating ring means is normally axially biased into a noncamming position.

13. Apparatus of claim 12, wherein said outer housing is formed with a ledge and the actuating ring means includes a shoulder, said ledge defining a stop surface against which said shoulder is normally axially biased.

14. Apparatus of claim 13, wherein said outer housing is open at front and rear ends thereof, said forming anvil being disposed in the front end, and further including a cam follower mounting plate attached to close the rear end.

15. Apparatus of claim 14, wherein said actuating ring means is a cylindrical member and further including spring means housed in a spring housing cavity formed in an axially rearwardly extending portion of the actuating ring means, said spring means engageable with an inner surface of the mounting plate to provide said normal axial bias.

16. Apparatus of claim 15, wherein said forming finger means is comprised of a rear mounting base section and a cylindrical section extending axially forwardly from the base section within the outer housing, said cylindrical section containing a plurality of circumferentially spaced longitudinally extending cuts terminating at the rear mounting base section to define a plurality of forming fingers between said cuts constituting said forming finger means.

17. Apparatus of claim 16, wherein said fingers extend continuously around the forming finger means to deform substantially the entire periphery of the second portion of the bottom wall.

18. Apparatus of claim 16, wherein adjacent ones of said fingers are spaced apart from each other to intermittently deform said second portion of the bottom wall.

19. Apparatus of claim 10, wherein said container supporting means is a cylindrical member concentrically mounted about the forming anvil means for axial sliding movement relative thereto, said cylindrical member having an annular supporting surface engageable with the container annular support surface.

20. Apparatus of claim 19, further comprising forming anvil support fixedly mounted within the outer housing; means for forwardly axially spacing said forming anvil from the forming anvil support; said container supporting means including a radially extending wall disposed between the forming anvil and the forming anvil support; and means for normally resiliently biasing the cylindrical container supporting means toward the second axial position by urging the radial wall against a rear stop surface of the forming anvil.

21. Apparatus of claim 20, further comprising a stripper actuating rod extending axially slidably through the forming anvil support means for connection to said control means, said rod including a drive surface adapted, during rearward axial movement, to engage the radial wall of the cylindrical container supporting means to retract the annular container supporting surface into the first axial position against said resilient bias.

22. Apparatus of claim 21, wherein said control means further includes:

a) a cam lever;

b) means for mounting said cam lever to the apparatus to define a lever fulcrum supported on said outer housing;

c) cam follower means connected to one end of the lever to contact an external camming surface, the other end of said lever being connected to the rod to axially move same and thereby the container annular supporting surface between said first and second axial positions in response to rotation of said cam lever about the fulcrum induced by relative axial displacement between the fulcrum and said external camming surface.

23. Apparatus of claim 22, wherein actuating ring means includes a cam follower mounting portion, and further including second cam follower means mounted thereto, said other end of the cam lever being spaced from the second cam follower means to pivot into contact with same after axially moving the rod to move the container annular supporting surface into said first axial position to thereby axially move the actuating ring means to initiate radially inward reforming movement of the forming finger means.

24. Apparatus of claim 23, wherein said cam follower mounting portion includes a pair of mounting portions diametrically opposed to each other, said second cam follower means including a pair of rolls respectively mounted to the mounting portions.

25. Apparatus of claim 24, wherein said cam lever includes a cylindrical mounting hub, and further including a mounting pin extending through the hub and having opposite ends respectively received in said mounting means.

26. Apparatus of claim 25, wherein said one end of the cam lever is forked to receive a cam follower roll.

27. Apparatus of claim 23, further comprising means for mounting said apparatus to a base pad turret of a necking machine, said camming surface being a stationary cam rail mounted to a machine frame supporting the base pad turret.

* * * * *